US006212722B1

(12) United States Patent
Pinkowski et al.

(10) Patent No.: US 6,212,722 B1
(45) Date of Patent: Apr. 10, 2001

(54) APPARATUS AND METHOD FOR ROLLING CLOTHES IN AN AUTOMATIC WASHER

(75) Inventors: Robert J. Pinkowski, Baroda; Kathleen M. La Belle, Lawrence; Matthew Craig Parsons, Dowagiac, all of MI (US)

(73) Assignee: Whirpool Corporation, Benton Harbor, MI (US)

( * ) Notice: Subject to any disclaimer, the term of this patent is extended or adjusted under 35 U.S.C. 154(b) by 0 days.

(21) Appl. No.: 09/351,391

(22) Filed: Jul. 13, 1999

(51) Int. Cl.[7] ..... D06F 17/06
(52) U.S. Cl. ..... 8/158; 8/159; 68/134
(58) Field of Search ..... 8/158, 159; 68/134

(56) References Cited

U.S. PATENT DOCUMENTS

| | | | | |
|---|---|---|---|---|
| 2,695,510 | | 11/1954 | Clark | 68/23 |
| 3,478,373 | | 11/1969 | McBride et al. | 8/158 |
| 4,137,736 | * | 2/1979 | Platt et al. | 68/134 |
| 4,328,600 | * | 5/1982 | Bochan | 8/159 |
| 4,494,390 | | 1/1985 | Hayashi et al. | 68/23.7 |
| 5,595,072 | | 1/1997 | Bai et al. | 68/133 |
| 5,619,870 | | 4/1997 | Kim et al. | 68/3.55 |
| 5,638,704 | | 6/1997 | Kim et al. | 68/3 |

* cited by examiner

*Primary Examiner*—Philip R. Coe
(74) *Attorney, Agent, or Firm*—Thomas J. Roth; Robert O. Rice; Joel M. Van Winkle

(57) ABSTRACT

A method and apparatus for washing cloth items in an automatic washer is provided wherein the automatic washer includes a wash basket defining a wash chamber and an impeller located within the bottom of the wash chamber. The method includes loading cloth items into the wash chamber and then supplying a quantity of wash liquid into the wash chamber sufficient to moisten the cloth items but insufficient to cause the cloth items to lose frictional engagement with the impeller as the impeller oscillates. The impeller is oscillated to apply a drag force to the cloth items in contact with the impeller such that the cloth items in contact with the impeller move angularly along an arc-like path. Angular movement of the cloth items disposed along the bottom of the wash chamber beyond the outer periphery of the impeller is impeded such that relative angular motion is created between the cloth items disposed along the periphery of the impeller and the cloth items disposed immediately above the impeller. Cloth items move radially inward along the impeller, move upwardly in the center of the wash chamber, move radially outwardly along the top of the wash chamber and move downwardly along the side wall of the wash chamber in a pattern which may be referred to as an inverse toroidal rollover path or pattern. This inverse toroidal rollover pattern is created by direct contact between the oscillating impeller and the cloth items supported above the impeller.

31 Claims, 9 Drawing Sheets

APPARATUS AND METHOD FOR ROLLING CLOTHES IN AN AUTOMATIC WASHER

BACKGROUND OF THE INVENTION

1. Field of the Invention

The present invention relates to a system for washing clothes in an automatic washer and more particularly to an apparatus and method for causing clothes or cloth items to move within the wash chamber of an automatic washer.

2. Description of the Prior Art

FIG. 1 illustrates a conventional vertical axis washer 10 having a center agitator 12 provided within a vertical axis wash basket 14 which is rotatably supported within a tub 16. The agitator 12 extends upwardly from the bottom wall of the basket 14 and typically has a height which is substantially equal to the height of the wash basket 14. In the field of automatic washing machines of this type, it has long been accepted that the most efficient clothes movement is a pattern which provides a rollover of the clothes or cloth items down the agitator barrel, then radially outward from the oscillating agitator vanes, upward along the wall of the basket. This pattern may be described as a toroidal rollover pattern. This movement is most effectively achieved in automatic washers which have dual action agitators, such as disclosed in U.S. Pat. No. 4,068,503 wherein a top auger portion is driven in a unidirectional rotary motion and a bottom portion, having flexible vanes, is driven in an oscillatory motion.

To achieve this type of toroidal rollover pattern, vertical axis washers having center agitators require a deep fill of wash liquid as the movement of clothes within the wash basket depends on fluid motion or fluid power. U.S. Pat. No. 4,068,503 and similar wash systems, at least in part, pump wash liquid within the wash basket in a toroidal rollover pattern, as shown by the flow arrows F, such that clothes within the wash basket are moved along with the flow of wash liquid. Without free fluid movement which allows for fluid pumping and the use of fluid power, these systems do not function. Accordingly, in a vertical axis washer having an agitator, effective rollover of the clothes can not be achieved when an insufficient amount of water is supplied into the wash tub. Effective rollover requires an amount of water which completely, or almost completely, submerges the clothes load such the clothes are suspended in wash liquid.

FIG. 2 illustrates a second type of vertical axis washer 20 wherein a relatively flat or low height, disk-like impeller or pulsator 22 is provided along the bottom wall of a wash basket 24 which may be rotatably supported within a tub 26. In a similar manner to vertical axis washing machines employing agitators, for automatic washing machines of this type it has long been accepted that the most efficient clothes movement is a pattern which provides a toroidal rollover of the clothes or cloth items within the wash basket. During operation of this type of washing machine, the impeller 22 is rotated or oscillated to create water flow as indicated by the flow arrows. Clothes items are washed by moving within the wash basket along with the water flow.

Just as with the vertical axis washers having center agitators, automatic washers having bottom impellers require a deep fill of wash liquid to achieve the desired toroidal rollover pattern as the movement of clothes within the wash basket depends on fluid motion or fluid power. The bottom impellers or pulsators pump wash liquid within the wash basket in a toroidal rollover pattern such that clothes within the wash basket are moved along with the flow of wash liquid. Without free fluid movement which allows for fluid pumping and the use of fluid power, these systems do not function well.

FIG. 3 illustrates the dual energy transmission path for creating cloth movement within the conventional wash systems described above. Rotational energy from a motor is transferred to a shaft which is drivingly connected to either an agitator or an impeller, depending on the vertical axis wash system used, having at least one drive surface referred to in FIG. 3 as a vane. Two paths of mechanical energy transmission occur within the washer—the vane transfers energy to the water in the wash basket and also directly transfers energy to cloth items in the wash basket. The energy transferred to the water in the wash basket results in fluid flow and fluid power being transferred to cloth items within the wash basket such that cloth movement occurs. Fluid flow also reduces the frictional engagement between the basket side walls and the cloth items thereby promoting cloth items motion. Moreover, fluid flow transfers some torque to the wash basket. The direct contact between the vane and the cloth item results in cloth motion. The cloth motion in turn leads to additional fluid motion and some torque is transferred to the wash basket.

It can be understood, therefore, that there are generally two types of vertical axis automatic washing machines—center agitator type machines and bottom impeller or pulsator type machines. Both of these types of vertical axis washers are designed for washing clothes in a deep fill of wash liquid wherein wash liquid is supplied into the wash basket to a level sufficient to completely submerge the cloth items which are loaded into the wash basket. Fluid power is a critical component in achieving effective cloth movement within these wash systems. In fact, the prior art teaches that these systems are not capable of moving clothes within a wash basket in a toroidal rollover pattern to achieve effective cleaning without free water for generating fluid power.

SUMMARY OF THE INVENTION

According to the present invention, therefore, a wash system is provided for moving cloth items within a wash chamber in an inverse or inverted toroidal rollover pattern. The motion of cloth items within the wash chamber is created by direct contact between an oscillating impeller and the cloth items supported above the impeller. Fluid pumping and fluid power are not used for moving fabric items in the wash chamber.

A method of washing cloth items in an automatic washer is provided wherein the automatic washer includes a wash basket defining a wash chamber and an impeller located within the bottom of the wash chamber. The method includes loading cloth items into the wash chamber and then supplying a quantity of wash liquid into the wash chamber sufficient to moisten the cloth items but insufficient to cause the cloth items to lose frictional engagement with the impeller as the impeller oscillates. The impeller is oscillated to apply a drag force to the cloth items in contact with the impeller such that the cloth items in contact with the impeller move angularly along an arc-like path. Angular movement of the cloth items disposed along the bottom of the wash chamber beyond the outer periphery of the impeller is impeded such that relative angular motion is created between the cloth items disposed along the periphery of the impeller and the cloth items disposed immediately above the impeller. As a result, cloth items move radially inward along the impeller, move upwardly in the center of the wash chamber, move radially outwardly along the top of the wash chamber and move downwardly along the side wall of the wash chamber in a pattern which is referred to as the above mentioned inverse toroidal rollover path or pattern. This inverse toroidal rollover pattern is created by direct contact between the oscillating impeller and the cloth items supported above the impeller. In the present invention, fluid pumping or fluid power is not the major drive used for moving cloth items in the wash chamber.

According to another aspect of the invention, a center post is provided extending upwardly from the center of the impeller. The center post includes an auger portion having at least one auger vane for lifting cloth items. The auger portion is driven in a unidirectional manner for lifting the cloth items disposed along the center post to promote rollover of the cloth items along the inverse toroidal path.

The present invention involves balancing the application of forces on cloth items within the wash chamber. More particularly, the present invention includes balancing the forces applied to the cloth items above the impeller and the forces applied to cloth items disposed along the periphery of the impeller such that relative angular motion is created between the cloth items above the impeller and the cloth items disposed along the periphery of the impeller wherein cloth items are driven to move along an inverse toroidal path in the wash basket.

DETAILED DESCRIPTION OF THE PREFERRED EMBODIMENTS

The present invention is directed to a unique wash system and method of operating a washer wherein cloth items within the washer are moved in a unique inverted or inverse toroidal rollover manner. The applicants have discovered that this inverse toroidal rollover cloth movement within a washer can be achieved by balancing the forces applied to the cloth items within the washer. More specifically, the applicants have discovered that for particular low water fill level conditions, oscillating movement of an impeller will cause cloth items loaded within a wash basket to move within the wash basket in the inverse toroidal manner described herein below.

Figure 1:
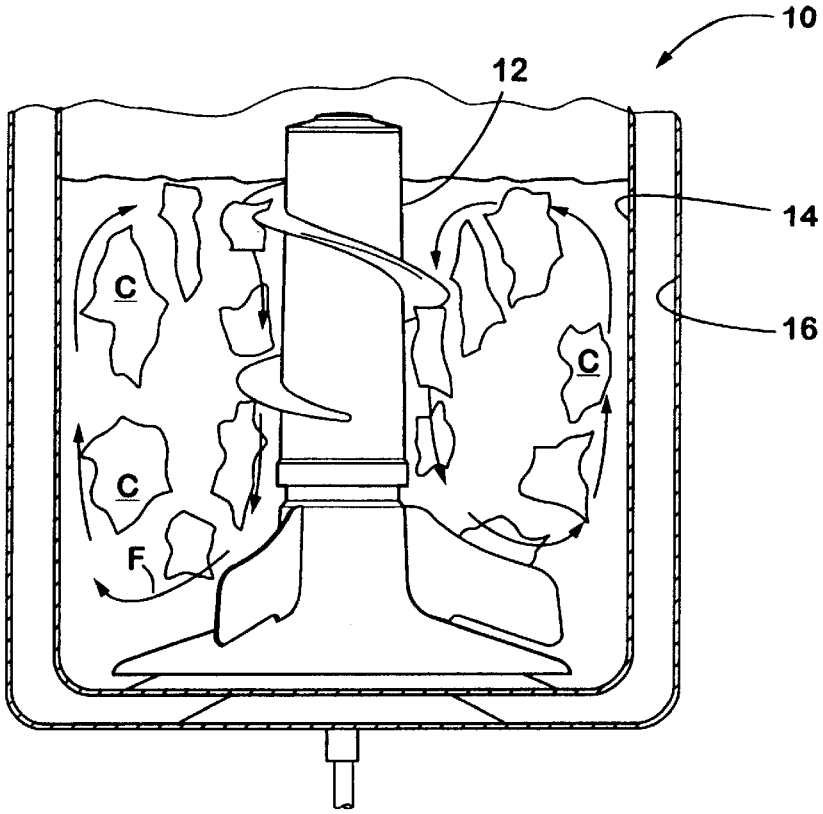
Fig. 1 PRIOR ART
FIG. 1 is a side sectional view illustrating a conventional washing machine having a center agitator.
Figure 2:
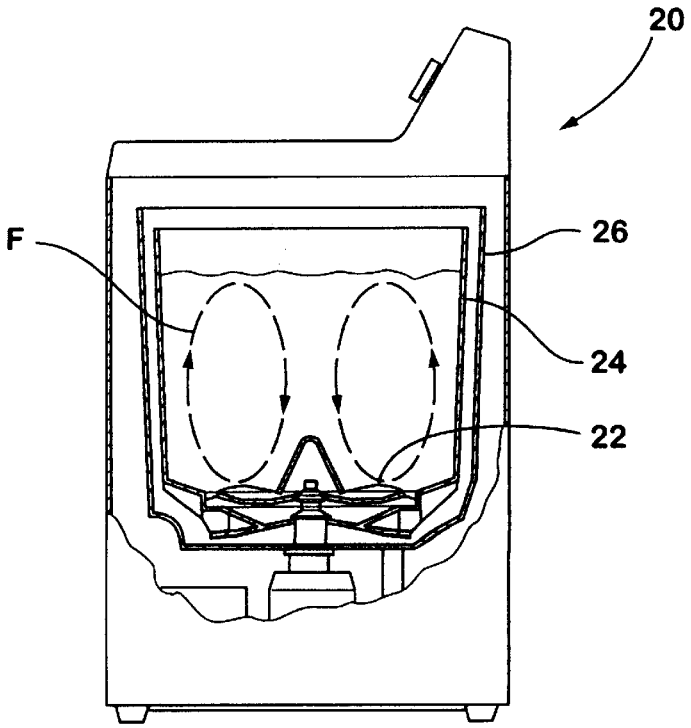
Fig. 2 PRIOR ART
FIG. 2 is a side sectional view illustrating a conventional washing machine having a bottom impeller.
Figure 3:
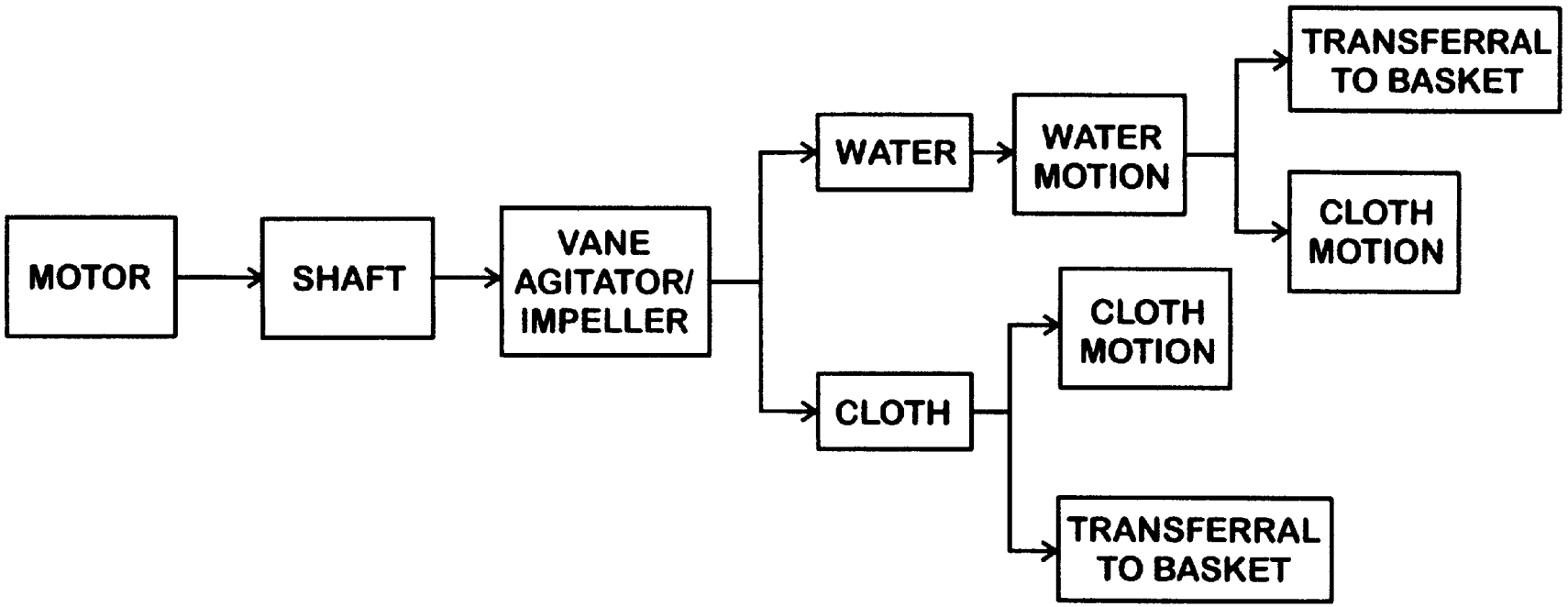
Fig. 3 PRIOR ART
FIG. 3 is a energy transmission path diagram illustrating the transmission of energy to cloth items in a conventional automatic washer.
Figure 4:
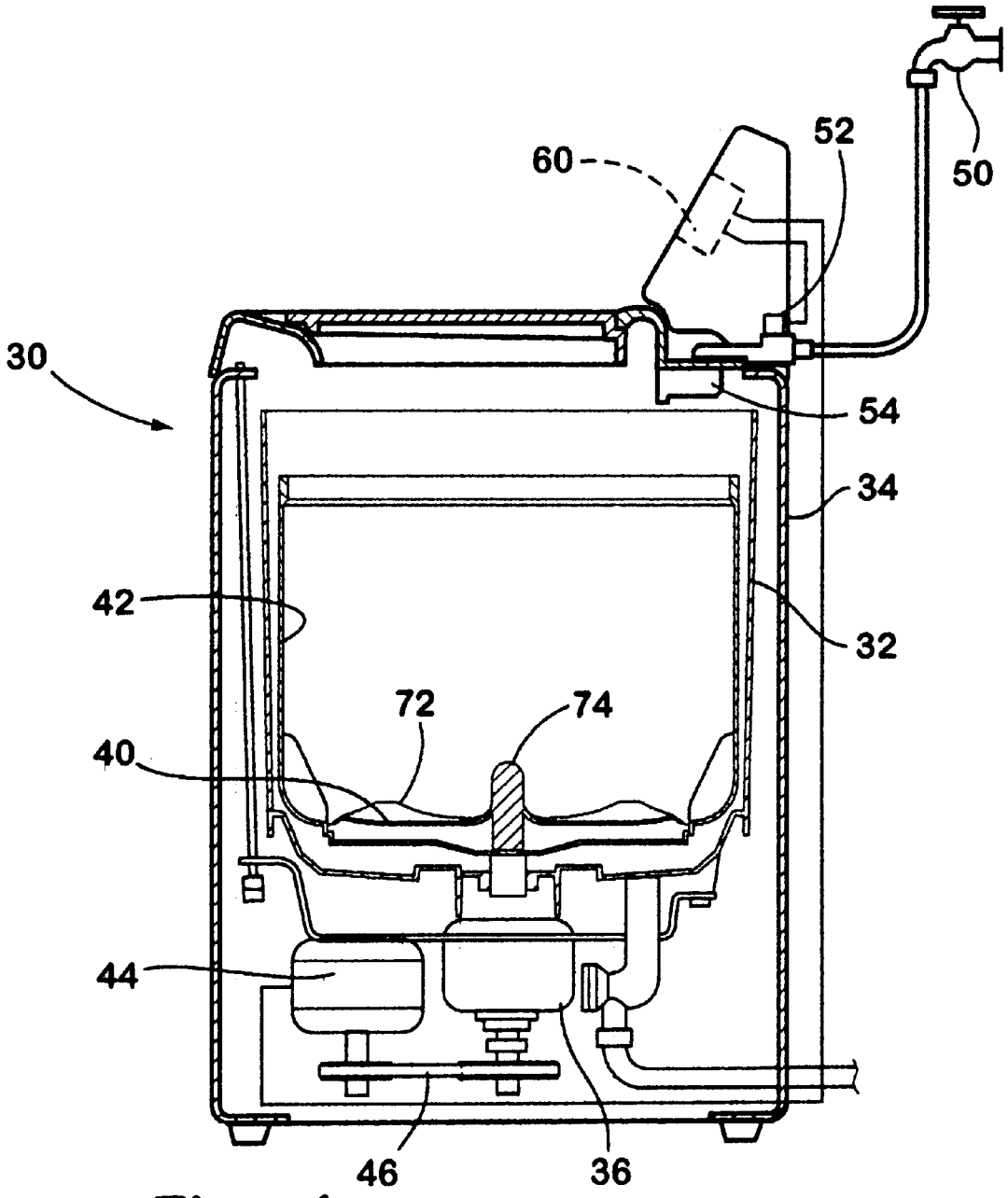
FIG. 4 is a side sectional view for illustrating one embodiment of an automatic washer according to the present invention.

The present invention may be embodied in an automatic washer, as shown in FIG. 4, where there is shown an automatic washer 30 having an outer tub 32 which is disposed and supported within a cabinet structure 34. A power transmission device 36 is provided below the tub for rotatably driving a impeller 40 and a wash basket 42. The wash basket 42 is rotatably supported within the tub 32. Drive power is transmitted from a motor 44 to the power transmission device 36 via belt 46. Alternatively, the present invention could readily be employed in an automatic washer which employed a direct drive type power transmission system.

During periods of the automatic washer operation, water is supplied into the washer 30 from an external source 50. Preferably, both a hot water and cold water supply is fluidly connected to the automatic washer 30. A flow valve 52, controls the inlet of wash liquid into the washer 30. Wash liquid is sprayed into the wash basket 42 through an inlet nozzle 54. A controller 60 is provided for controlling the operation of the washer in accordance with the present invention. The controller 60 is operatively connected to the motor 44 and the flow valve 52.

Figure 5:
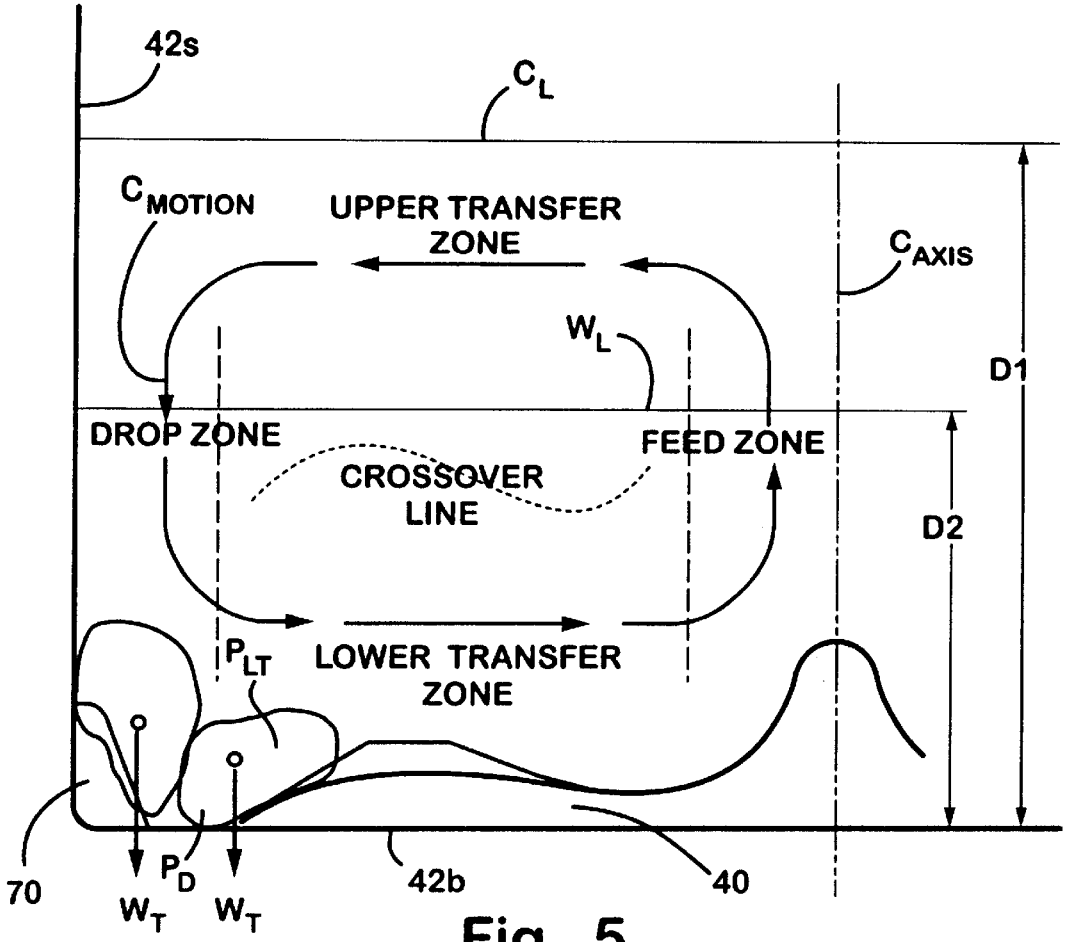
FIG. 5 is a side sectional view of one half of the wash chamber of the automatic washer according to FIG. 4 schematically illustrating the movement of cloth items within the automatic washer of FIG. 4 in accordance with the present invention.
Figure 6:
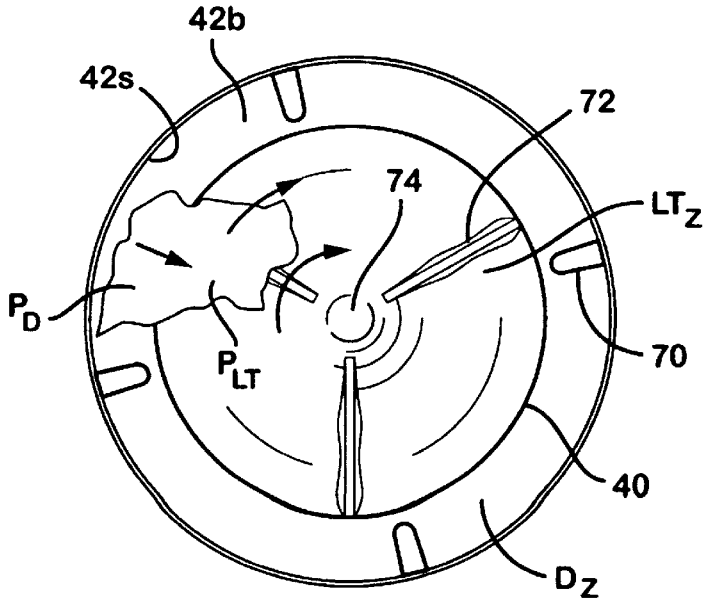
FIG. 6 is a top view of the wash chamber of the automatic washer according to FIG. 4 schematically illustrating the movement of cloth items within the automatic washer of FIG. 4 in accordance with the present invention.

FIGS. 5 and 6, when considered in combination with FIG. 4, provide schematic illustrations which are useful for explaining the surprising and counter-intuitive discovery on which the present invention is based. Additionally, the applicants have developed a theory of cloth movement to explain the present invention which can be described in reference to FIGS. 5 and 6.

The wash basket 42 is shown having a generally circular bottom wall 42*b* and generally cylindrical side wall 42*s*. Cloth items or clothes loaded into the wash basket fill the basket 42 up to a clothes level indicated as line $C_L$ which is a first distance D1 above the bottom wall 42*b*. Water is supplied into the wash basket 42 such that water fills the wash basket up to a level $W_L$ which is a second distance D2, equal to or less than D1, above the bottom wall 42*b*. When the impeller 40 is oscillated, the cloth items within the wash basket 42 move within the basket along a cloth motion path labeled $C_{motion}$. This path $C_{motion}$ of cloth movement is a pattern which provides rollover of the cloth items or clothes within the wash basket 42 down the cylindrical side wall 42*s*, radially inward along the impeller 40, upward along the center axis $C_{axis}$ of the impeller 40 and then radially outward at the upper portion of the cloth load. This path is the inverted or inverse toroidal rollover pattern of cloth motion which the present invention creates.

It should be appreciated that the expression inverse toroidal motion or inverse toroidal rollover motion are broad terms that are used describe the rollover motion defined above. Clearly, the motion of the cloth items in the wash basket, as described above, may not follow a path that is in strict sense toroidal. However, inverse toroidal rollover is meant to refer to the general motion of cloth items along a path which is upwardly in the center of the wash basket 42, outwardly along the top of the cloth item load, downwardly along the side wall 42*s* of the basket 42 and inwardly along the bottom of the basket 42 adjacent the impeller 40. Moreover, the inverse toroidal motion of the present invention refers to the overall motion of the cloth items, not any particular cloth item. Any particular cloth items pushed upwardly along the center axis $C_{axis}$ of the impeller 40 may be drawn outwardly along the top of the cloth items load in any radial direction and may therefore follow a path which comprises a series of toroidal like rollover patterns.

This inverse toroidal rollover pattern of cloth motion is surprising and counter-intuitive in view of the prior art. The prior art suggests that the motion of an impeller 40 will urge clothes or cloth items outwardly due to the fact that the rotational motion of the impeller 40 would be expected to impart a centrifugal force which would tend to urge clothes items radially outward. It would therefore be expected that the clothes adjacent the impeller would be urged to move radially outward—not inwardly as the present invention teaches. Moreover, with a water fill level which is insufficient to submerge the clothes items, it would be expected that impeller motion would be unlikely to create toroidal cloth motion. Rather, it would be expected that the cloth item load would in effect "stall" and toroidal motion would not occur.

An understanding of how the surprising results of the present invention are achieved can be better understood by dividing the cloth load in to various regions or zones. When considering a cross-sectional view of the cloth load, such as shown in FIG. 5, the cloth load can be separated into four general zones. An upper transfer zone $UT_Z$, a drop zone $D_Z$, a lower transfer zone $LT_Z$ and a feed zone $F_Z$. The applicants believe that the unique inverse toroidal motion is achieved by balancing the forces which are applied to the clothes in the drop zone $D_Z$ and the lower transfer zone $LT_Z$.

As can be understood by one skilled in the art, there are certain forces which tend to hold the cloth load motionless. The weight WT of the cloth load and the frictional forces F generated between the cloth load and the wash basket 42 are likely the primary forces which hold the cloth load stationary. However, when the impeller 40 oscillates, the frictional engagement between the impeller 40 and the cloth items in the lower transfer zone $LT_Z$ adjacent the impeller 40 creates forces on the cloth items in the lower transfer zone $LT_Z$ such that cloth items in the transfer zone $LT_Z$ are dragged along with the impeller 40.

FIG. 6 illustrates the result of these forces schematically. As the impeller 40 is moved clockwise, the cloth items above the impeller 40 in the lower transfer zone $LT_Z$ are oscillated along with the impeller 40 along an arc-like path. The drop zone $D_Z$ is beyond the outer periphery of the impeller 40 and therefore the impeller 40 can not act directly on the clothes items provided along the bottom of the drop zone $D_Z$. The forces holding the cloth items in the drop zone $D_Z$, the clothes weight WT and the frictional forces F, counteract whatever drag forces are transferred from the clothes item moving in the lower transfer zone $LT_Z$ such that the clothes items in the bottom of the drop zone $D_Z$ do not move angularly with the impeller 40 along an arc-like path.

The inventors believe that the inverse toroidal rollover motion is primarily driven by the motion of the clothes items located at the interface between the drop zone $D_Z$ and the lower transfer zone $LT_Z$, as best shown in FIGS. 5 and 6. For those clothes items that are located along the bottom outer periphery of the wash basket 42 in both the drop zone $D_Z$ and the lower transfer zone $LT_Z$, the motion in the drop zone DZ due to impeller oscillation is radially inward. This can be understood, it is believed, by recognizing that for a particular cloth item in this transition area, the portion $P_{LT}$ of the cloth item in the lower transfer zone $LT_Z$ is moved radially along with the impeller 40 while the portion $P_D$ of the cloth item in the drop zone $D_Z$ experiences forces which resists radial movement. As the portion $P_{LT}$ of the cloth item in the lower transfer zone $LT_Z$ is dragged along with the impeller 40, the portion $P_D$ that is in the drop zone $D_Z$ is pulled radially inward. Clothes items within the drop zone $D_Z$, immediately above the cloth item portion $P_D$ in the drop zone being pulled radially inward, move down into the vacated space in the bottom of the drop zone $D_Z$. This action of inward radial motion within the bottom of the drop zone $D_Z$ and the resultant dropping down of cloth items within the drop zone $D_Z$, drives the inverse toroidal rollover motion of the cloth items within the wash basket 42.

As the impeller 40 is oscillated, therefore, cloth items positioned in both the drop zone $D_Z$ and the lower transfer zone $LT_Z$ are moved radially inward. This movement pushes those cloth items in the lower transfer zone $LT_Z$ radially inward. Additionally, cloth items in the drop zone $D_Z$ fall down into the space vacated by the cloth items which are urged radially inward. The cloth items in lower transfer zone $LT_Z$ are, therefore, forced toward the center of the wash basket 42. Clothes in the center of the basket 42 in the feed zone $F_Z$ are forced upward toward the top of the cloth load. Clothes in the upper transfer zone $UT_Z$ are pushed toward the outer perimeter of the wash basket by the clothes which are being pushed upward in the center of the basket. Clothes in the drop zone $D_Z$ move downwardly along the basket side wall 42*s* to replace the clothes being moved radially inward in the lower transfer zone $LT_Z$.

The applicants believe that there are many factors in an automatic washer which influence establishing effective inverse toroidal rollover motion. For example, it is believed that the amount of cloth items loaded into the washer; the amount of water added into the washer, the shape of the impeller, the movement of the impeller and the configuration of the wash basket into which the cloth items are loaded can all affect the establishment of inverse toroidal rollover motion. These factors are all related to a basic principle which the applicants have discovered regarding establishing inverse toroidal rollover motion. The basic principle is that to achieve inverse toroidal rollover motion in an automatic washer as shown in FIG. 4, there must be relative angular motion between the cloth items in the lower transfer zone $LT_Z$ and the cloth items in the drop zone $D_Z$. Specifically, the impeller 40 must be configured and rotated in a manner such that clothes above the impeller 40 within the lower transfer zone are dragged along with or move angularly, at least to some degree, in an arc-like path with the impeller 40. There can not be significant separation between the impeller 40 and the cloth items such as may occur if the impeller 40 is rotated at too high a speed or with to great an acceleration or such as may occur if too much water is supplied into the wash basket 42. Additionally, the clothes in the bottom outer perimeter of the wash basket—in the bottom of the drop zone $D_Z$—must be prevented from moving angularly along with the motion of the cloth items in the lower transfer zone $LT_Z$, at least to some degree.

The shape of the wash basket 42 may have some impact on the above stated basic operating principle. Specifically, it appears important to set up forces which have a tendency to hold the cloth items in the lower drop zone $D_Z$ stationary. To that end, a plurality of protrusions 70 are provided along the bottom corner of the wash basket 42. While these protrusions 70 are not required, it is believe that they increase the resistance to angular or rotational motion of the cloth items in the drop zone $D_Z$ such that the cloth items in the drop zone $D_Z$ do not move with the impeller in an arc-like path thereby setting up the radially inward motion. In a similar manner, rib-like structures may be provided longitudinally along the wash basket side wall 42*s* to increase resistance to rotational motion. It should be noted that the applicants believe that inverse toroidal rollover motion may be established, even if the impeller 40 extends across the entire bottom of the basket. However, such a configuration would not be ideal as cloth items in the drop zone $D_Z$ would tend to move angularly in an arc-like path with the cloth items in the lower transfer zone $LT_Z$.

The configuration of the impeller 40 likewise has an impact on establishing inverse toroidal rollover motion. It is believed by the applicant, that the impeller is preferably designed to promote the application of dragging forces on the cloth items in the lower transfer zone $LT_Z$. To this end, it is desirable to provide the impeller 40 with a plurality of ribs or protrusions 72. Moreover, the impeller 40 should be designed to avoid what may be referred to as center clogging. Center clogging occurs when the cloth items being push upwardly along the center axis if the impeller 40 are impeded in a manner which slows or prevents inverse toroidal rollover motion. To avoid center clogging, the impeller may be provided with a raised center 74. Additionally, the impeller 40 preferably does not include large radial fins extending along or adjacent to the impeller as these are believed to impede inverse toroidal rollover motion.

Another factor which appears to be important in practicing the present invention is the motion of the impeller. As described above, the impeller 40 is oscillated. As used herein, the term oscillate as related to impeller motion describes impeller motion wherein the impeller 40 is alternately rotated in a first direction and then in a reverse direction. The impeller 40 may complete many full revolutions while rotating or spinning in one direction before being reversed to rotate in the opposite direction. The rotation or spinning of the impeller 40 in any particular direction may be referred to as a stroke such that the oscillation of the impeller 40 involves a stroke in a first direction followed by a stroke in a second direction repeated a plurality of times. Each stroke may include rotating the impeller 40 through many complete revolutions.

Figure 7:
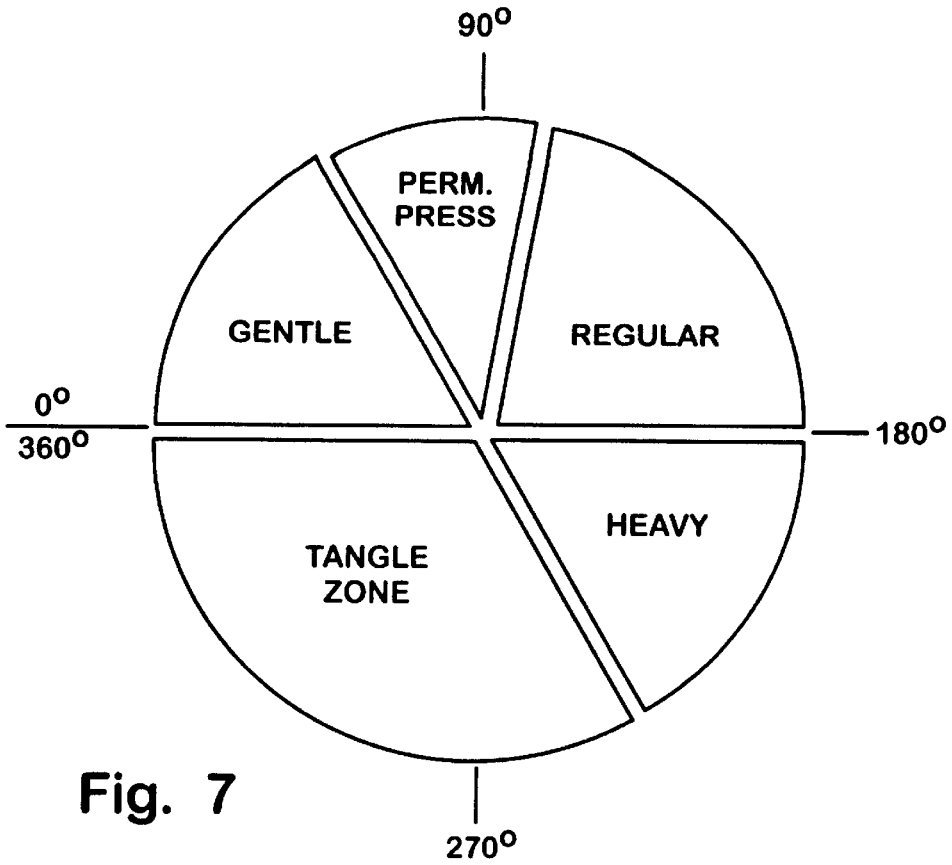
FIG. 7 is a graphical representation of cloth item stroke angles and the results the cloth item stroke angles have on the operation of the present invention.

The amount of rotational motion the cloth items experience for each stroke of the impeller 40, referred to as the cloth item stroke angle, will effect the motion of the cloth items in the wash basket 42. FIG. 7 illustrates in graphical form how the inventors believe the cloth item stroke angle affects cloth item motion in the wash basket. If the impeller 40 is oscillated such that the cloth items experience a relatively small stroke angle, such as less than 60°, cloth items move along a inverse toroidal path slowly such that what may be referred to as a gentle wash is achieved. (Depending on other factors, a cloth item stroke angle of 60° may require an impeller stroke which includes rotating the impeller many full rotations.) Under a gentle wash, the cloth items may make a complete toroidal pass, or rollover, once every ten (10) minutes. As the cloth item stroke angle is increased, the rollover of cloth items along an inverse toroidal path occurs more rapidly. For example, for a cloth item stroke angle between 100°–180°, the cloth items may rollover once every five (5) minutes to achieve a regular or normal wash. Greater cloth item stroke angles may further increase the speed of rollover and result in what may be referred to as a heavy wash. At some cloth item stroke angle, believed to be about 250°–270°, the angular motion of the cloth items along an arc-like path will no longer promote the desired inverse toroidal rollover and instead, the cloth items will begin to tangle.

Another factor in practicing the present invention is the angular acceleration of the impeller as it oscillates. The angular acceleration of the impeller 40 is related to stroke rate. As stated above, it is important that there not be significant separation between the impeller 40 and the cloth items for the invention to be effectively practiced. If separation between the impeller 40 and the cloth items occurs, the cloth items in the lower transfer zone $LT_Z$ lose frictional contact with the impeller 40 and the cloth items will tend to move radially outward as a result of fluid power or motion. Under this condition, to the degree the cloth items move within the wash basket 42, they will be more likely to travel along a conventional toroidal path. Accordingly, it is desirable to rotate the impeller at a speed that allows the impeller 40 and the cloth items to stay in friction engagement, at least to some degree. The applicants have found that a stroke rate in the range of 10–40 RPM is well suited for practicing the invention.

Figure 8:
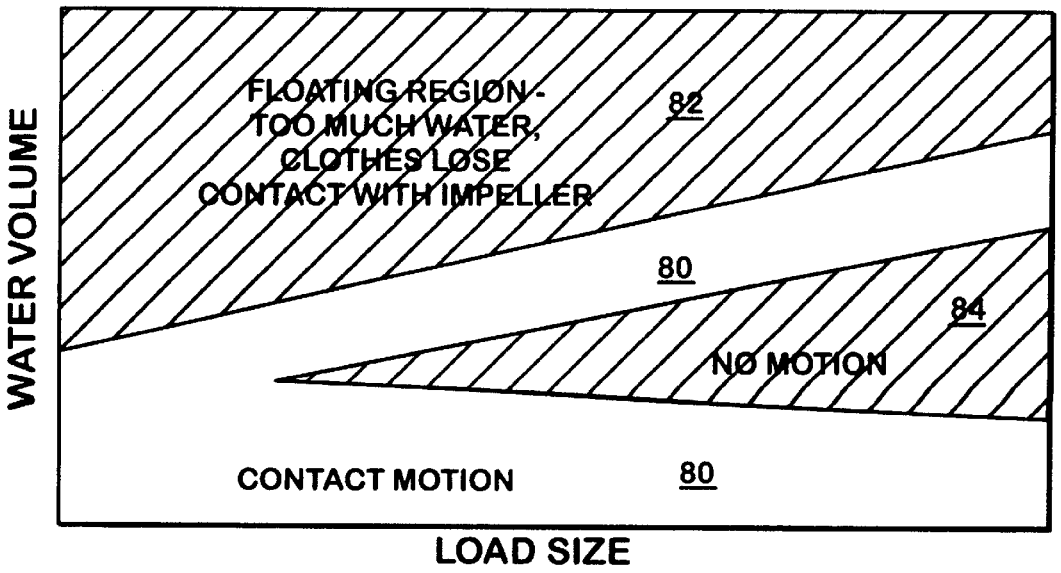
FIG. 8 is a graph of fill water volume vs. load size and illustrates what effect these factors have on the operation of the present invention.

The amount of water introduced into the wash tub is also an important factor in practicing the present invention. FIG. 8 is a graph which communicates the effect of the wash liquid level. Region 80 corresponds to where the cloth items can be moved in the inverse toroidal rollover motion. In general, a relatively low amount of wash liquid is desirable to achieve the inverse toroidal rollover motion. In fact, as shown by the area 80, if no wash liquid is supplied into the wash basket 42, the desired inverse toroidal rollover motion can be achieved. However, if wash liquid is introduced to a degree that the cloth items are allowed to float in the wash basket 42, the impeller 40 will not sufficiently frictionally engage the cloth items to drag the cloth items along an arc-like path. The region 82 corresponds to where too much water is present to allow for the desired inverse rollover motion. There is also a region 84 of relatively low water volume where, for larger cloth item loads, the inventors have found that the cloth items do not move in a inverse toroidal motion.

As can be appreciated, some system must be provided for controlling the amount of water inlet into the washer. There are many existing systems which provide for indirect control of the wash liquid supplied by sensing the size of a load in a wash basket and then supplying an amount of water into the washer in accord with the sensed load size. For example, load inertia may be used to sense the load size. Such a system may use an opto coupler wired in parallel to motor windings with the appropriate electronic circuitry or a tachometer mounted in such a way to sense pulley revolution or motor shaft revolution. Alternatively, a system may be provided to sense the amount of water used to sufficiently wet the load during the initial wash process. Basically, known systems work under the following generalized principles: 1) load is placed in the machine; 2) water may be added to some predetermined level; 3) motion is induced (impeller moves, basket spins, recirculation system recirculates, etc); 4) the system response is monitored; 5) the system response is referenced to a predicted load relationship; 6) the system picks load size; and 7) the system sets operating parameters based on load size.

Direct liquid level sensing may also be used to control the water level supplied in the present invention. For example, the water amount can be controlled to a specific water level in the tub or to a flow rate in a recirculation system. The impeller motion can be adjusted so that the amp draw or free wheel energy (as defined by the amount the motor moves after current has been turned off to the motor and/or the amount of time the stored energy in the capacitor can bounce between the motor and the capacitor in the circuit before the energy is dissipated below detectable levels) falls within a pre-defined range. This will produce a "self-adjusting" system that will give adequate performance.

Still further, and perhaps most simply, the amount of wash liquid supplied into the washer may be predetermined based on the cloth quantity value inputted by the washer operator. In such a system, the cloth quantity value, for example SMALL, MEDIUM, LARGE, EXTRA LARGE may be inputted to the washer controller via push buttons or a selector dial. In response, an amount of wash liquid, suitable for establishing inverse toroidal rollover motion may be supplied into the washer.

Figure 9:
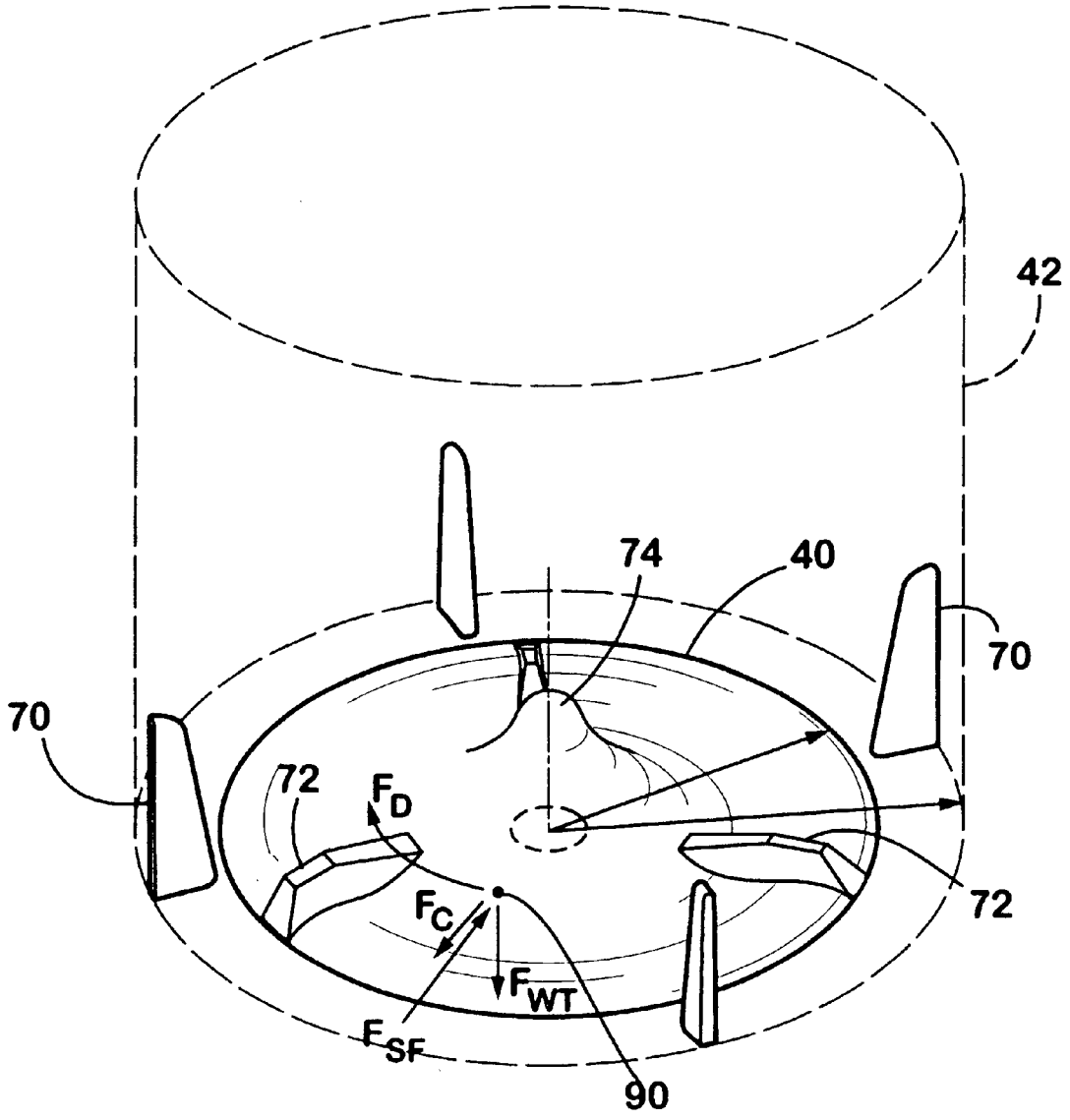
FIG. 9 is a schematic illustration of an impeller in accordance with the present invention, illustrating in free body diagram form the forces applied to cloth items in contact with the impeller.

Many of the above discussed factors, which affect the practice of the present invention, are related, to some degree, to the engagement between the cloth items in the lower transfer zone $LT_Z$ and the impeller 40 which allows the impeller 40 to drag to the cloth items in along an arc-like path in an oscillatory manner. This engagement between the impeller 40 and the cloth items can be discussed in terms of forces. In FIG. 9, a schematic illustration of the impeller 40 is shown with a point 90 identified representing a cloth item point which is in contact with the impeller 40. A free body diagram illustrating at least some of the forces acting on point 90 is shown. The cloth item weight creates a downwardly directed force shown as $F_{WT}$. This force creates a frictional resistance to relative movement between the cloth item point 90 and the impeller 40. The impeller 40 is driven to oscillate such that the impeller 40 undergoes angular acceleration $\omega$. The frictional engagement between the impeller 40 and the point 90 results in a drag force $F_D$ being applied to the point 90 in the direction of the impeller rotation. The drag force $F_D$ is countered by various forces including an inertial force which is not shown. The angular acceleration $\omega$ of the impeller 40 and the corresponding angular acceleration $\omega$ of the point 90 also creates a centrifugal force $F_C$ acting radially outward from the center of the impeller 40. The centrifugal force $F_C$ is resisted by the frictional resistance of movement which exists between the impeller 40 and the point 90, shown as static friction force $F_{SF}$.

The present invention is practiced when the drag force $F_D$ is sufficient to drag to cloth items in an oscillatory manner along with the impeller 40 such that the cloth items in the lower transfer zone $LT_Z$ are dragged with the impeller along an arc-like path. Moreover, the centrifugal forces $F_C$ on the cloth items must be less than the static friction forces $F_{SF}$ such that the cloth items in the lower transfer zone $LT_Z$ are not moved radially outward.

As discussed above, to effectively operate an automatic washer to achieve the inverse toroidal motion, the cloth items in the lower transfer zone $LT_Z$ must remain generally in contact with the impeller 40. More particularly, the automatic washer 30 must be designed and operated in a manner such that the centrifugal force $F_C$ is not greater than the static friction force $F_{SF}$. If $F_C$ is greater than $F_{SF}$, then the cloth items above the impeller 40 will have a tendency to move outwardly in a manner which defeats the desired radially inward motion of cloth items in the lower transfer zone $LT_Z$. Whether $F_C$ is greater than $F_{SF}$ will depend on a number of the above described factors, including the impeller 40 design, the amount of water supplied into the wash basket 42 and the acceleration at which the impeller 40 experiences. Likewise, the drag force $F_D$ must be sufficient to move the cloth items, at least to some degree, along with the impeller 40. This again will depend on the impeller 40 design, the amount of water supplied into the wash basket 42 and the acceleration at which the impeller 40 experiences.

The dragging of cloth items by the impeller 40 is distinguishable from the movement of cloth items due to fluid pumping cause by impeller oscillation. As stated herein, cloth motion due to the radially outward fluid pumping which is generated by the rotational motion of the impeller 40 actually defeats the desired inverse toroidal motion. While some fluid pumping can occur, the cloth items adjacent the impeller 40 must move primarily due to the dragging action or drag forces applied by the impeller 40. Obviously, fluid pumping systems, independent from impeller rotation may be provided to assist in reverse toroidal rollover motion. For example, one skilled in the art could readily envision a system for pump fluid upwardly through center of the impeller 40 to promote inverse toroidal motion. Fluid flow of this nature combined with the application of drag force by the impeller 40 on cloth items as described herein is clearly with the scope of what the inventors consider as their invention.

Figure 10:
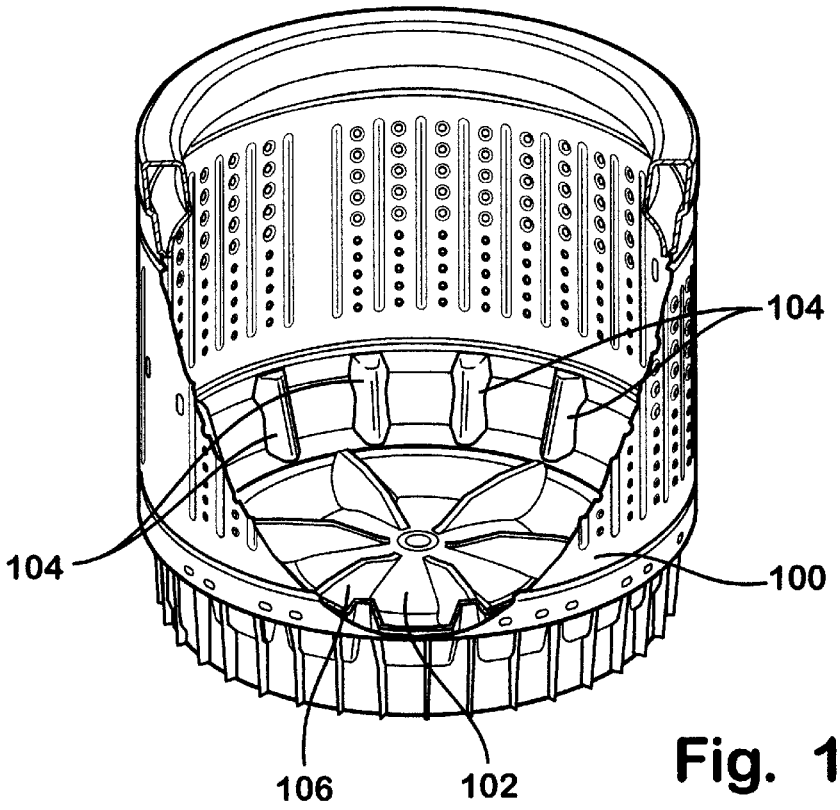
FIG. 10 is a partially cut away, perspective view of an alternative embodiment wash basket and impeller arrangement for practicing the present invention.

Turning now to FIGS. 10–16, some alternative wash basket and impeller/agitator configurations of the present invention are shown. Each of the disclosed wash basket and impeller/agitator embodiments can be used to drive inverse toroidal cloth motion. FIG. 10 discloses an wash basket 100 and an impeller 102. The wash basket 100 includes a plurality of protrusions 104 in the bottom peripheral corner. The impeller also includes a plurality of protrusions 106 for engaging cloth items loaded into the wash basket.

Figure 11:
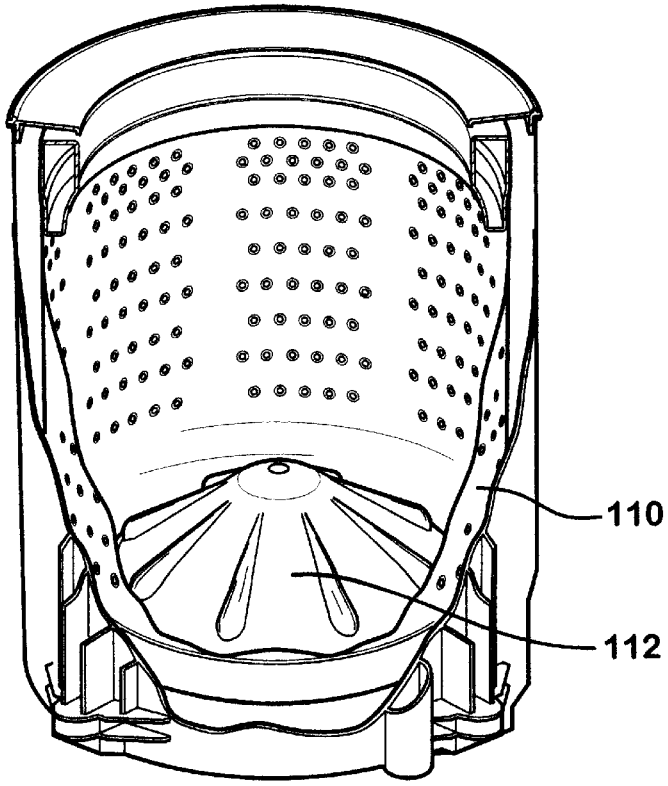
FIG. 11 is a partially cut away, perspective view of another alternative embodiment wash basket and impeller arrangement for practicing the present invention.

FIG. 11 also discloses wash basket 110 with a bottom impeller 112. In this embodiment, the wash basket 100 does not include bottom protrusions. This will likely lead to an increased tendency of the cloth items within the lower drop zone $D_Z$ to move with the cloth items being oscillated in the lower transfer zone $LT_Z$. Inverse toroidal cloth item rollover motion may still be achieved, however, by controlling other factors such as the acceleration and stroke angle of the impeller 112 oscillations and the amount of water added into the wash basket.

Figure 12:
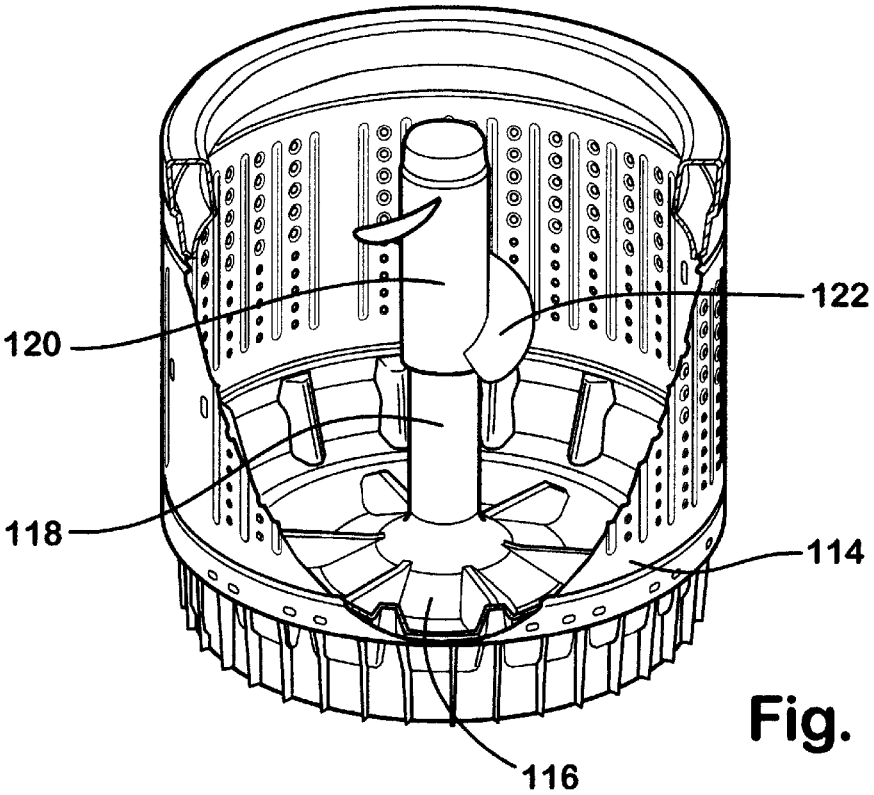
FIG. 12 is a partially cut away, perspective view of another alternative embodiment wash basket and impeller arrangement including a center post with an auger portion for practicing the present invention.
Figure 13:
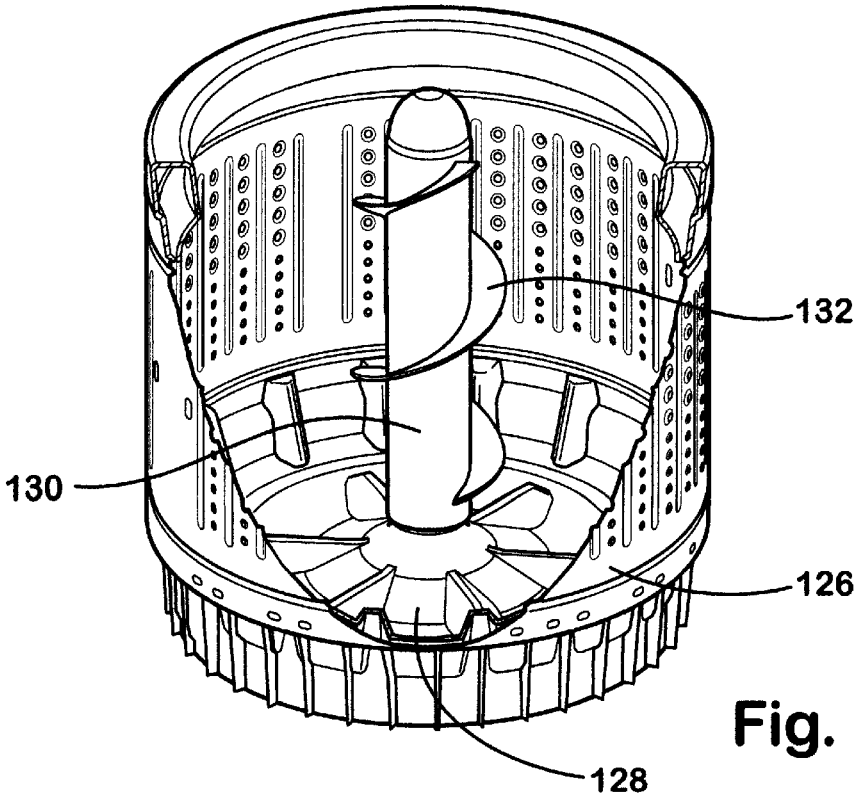
FIG. 13 is a partially cut away, perspective view of another alternative embodiment wash basket and impeller arrangement including a center post with an auger portion for practicing the present invention.

FIGS. 12 and 13 disclose alternative embodiments which include center posts extending from the center of the bottom impeller. In FIG. 12, a wash basket 114 is provided with a bottom impeller 116—both of which are similar to those disclosed in FIG. 10. In addition however, a center post 118 extends upwardly from the center of the impeller 116. The center post 118 includes a top auger portion 120 having at least one vane 122 for urging cloth items disposed adjacent the auger portion 120 upward. The auger portion 120 is supported for unidirectional motion such that vanes 122 urge cloth items upward. The auger portion 120 may be supported in a manner similar to U.S. Pat. No. 3,987,651, to Platt, or to U.S. Pat. No. 4,155,228, to Burgener, Jr. et al., or in some other known manner. In this embodiment, the auger portion 120 helps promote the inverse toroidal rollover motion of cloth items in the wash basket 114 by lifting cloth items along the center post 118 upwardly. This helps avoid what may be referred to as center clogging which can stall the inverse toroidal motion.

FIG. 13 is generally similar to FIG. 12 except an auger is provided along substantially the entire height of the center post. In particular, in FIG. 13, a wash basket 126 is provided along with a bottom impeller 128. A center post 130 extends upwardly from the center of the impeller 128 and includes at least one vane 132 which runs along substantially the entire length of the center post 130. The center post 130 is supported for unidirectional rotation such that the cloth items disposed adjacent the vane 132 are lifted upwardly. This promotes the inverse toroidal rollover motion of cloth items in the wash basket 126 and helps avoid what may be referred to as center clogging which can stall the inverse toroidal rollover motion.

Figure 14:
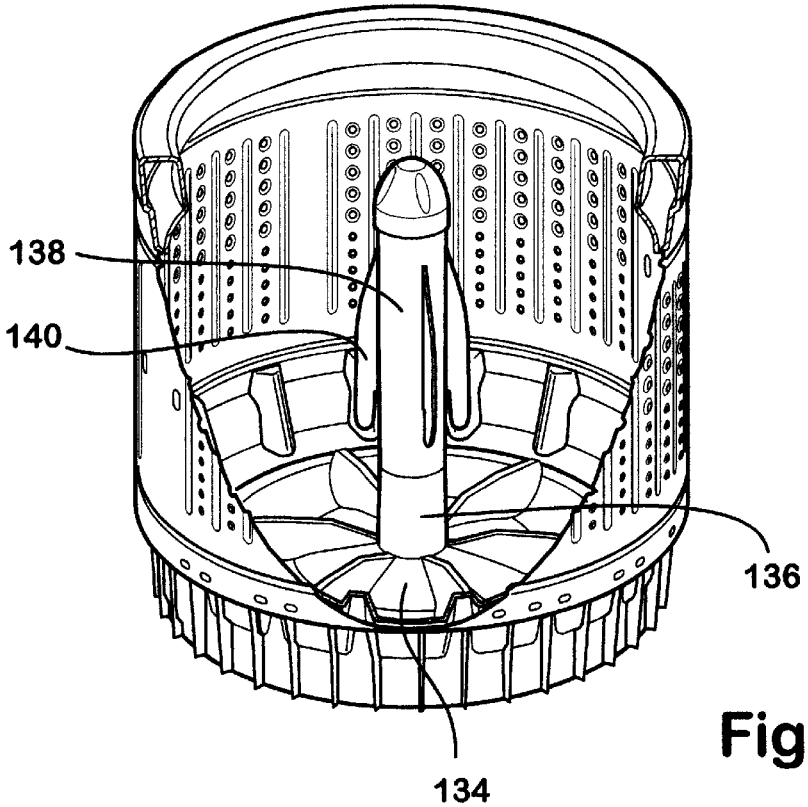
FIG. 14 is a partially cut away, perspective view of another alternative embodiment wash basket and impeller arrangement including a center post with radial ribs for practicing the present invention.
Figure 15:
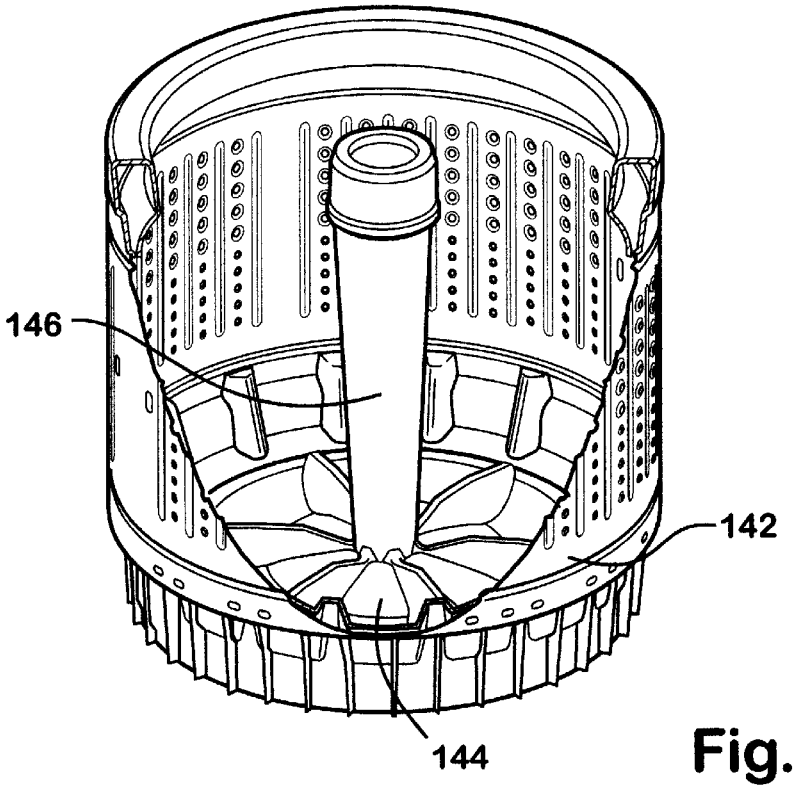
FIG. 15 is a partially cut away, perspective view of another alternative embodiment wash basket and impeller arrangement including a center post for practicing the present invention.

FIGS. 14 and 15 both disclose wash basket/impeller systems which include center posts. In FIG. 14, a center post 136 extends upwardly from an impeller 134. The center post 136 includes an upper portion 138 having a plurality of radial fins 140. FIG. 15 discloses a automatic wash basket 142, a bottom impeller 144 and a smooth center post 146. The center post 146 has an inverted frustroconical shape.

The present invention, therefore, provides for a novel automatic washer and wash process for moving cloth items within a wash chamber. The invention allows cloth items to be effectively cleaned while using relatively little water. Additionally, the present invention can be practiced to apply mechanical energy to cloth items in a relatively gentle manner such that little cloth item degradation occurs.

As is apparent from the foregoing specification, the invention is susceptible of being embodied with various alterations and modifications which may differ particularly from those that have been described in the preceding specification and description. It should be understood that we wish to embody within the scope of the patent warranted hereon all such modifications as reasonably and properly come within the scope of our contribution to the art. Those of skill in the art will recognize that changes may be made to the description above, which is merely discloses example embodiments of the present invention, without departing from the scope of the broad invention as set forth in the appended claims.

We claim:

1. A method of washing cloth items in an automatic washer having a wash chamber and an impeller located within the bottom of a wash chamber, the impeller being rotatable about a substantially vertical axis, the method comprising the steps of:

loading cloth items into the wash chamber;

supplying wash liquid into the wash chamber; and oscillating the impeller such that the cloth items above the impeller are dragged in an oscillatory manner along with the impeller wherein cloth items are driven to move along an inverse toroidal rollover path in the wash basket.

2. The method of washing cloth items according to claim 1, further comprising the steps of:

providing a drop zone within the wash chamber beyond the outer periphery of the impeller; and providing a lower transfer zone immediately above the impeller, wherein the cloth items in the lower transfer zone are dragged by the impeller along an arc-like path while the cloth items in the drop zone are held against oscillatory motion along an arc-like path such that the clothes in the lower transfer zone move relative to the clothes in drop zone.

3. The method of washing cloth items according to claim 2, further comprising the steps of:

supplying a quantity of wash liquid into the wash chamber sufficient to wet the cloth items but insufficient to provide free liquid in which the cloth items can be suspended in above the impeller; and impeding the angular movement of the cloth items in the drop zone such that relative angular motion is created between the cloth items in the drop zone and the cloth items in the lower transfer zone such that cloth items in the wash basket move along an inverse toroidal path.

4. The method of washing cloth items according to claim 2, further comprising the steps of:

supplying a quantity of wash liquid into the wash chamber sufficient to wet the cloth items but insufficient to cause the impeller to lose frictional engagement with the cloth items in the lower transfer zone; and impeding the angular movement of the cloth items in the drop zone such that relative angular motion is created between the cloth items in the drop zone and the cloth items in the lower transfer zone such that cloth items in the wash basket move along an inverse toroidal path.

5. The method of washing cloth items according to claim 2, further comprising the steps of:

balancing the forces applied to the cloth items within the drop zone and the lower transfer zone such that relative angular motion is created between the cloth items in the drop zone and the cloth items in the lower transfer zone such that cloth items in the wash basket move along an inverse toroidal path.

6. The method of washing cloth items according to claim 1, further comprising the steps of:

supplying a quantity of wash liquid into the wash chamber which is less than the quantity of wash liquid at which the cloth items lose frictional engagement with the cloth items directly above the impeller wherein the cloth items can not be readily dragged by the impeller.

7. The method of washing cloth items according to claim 1, further wherein the automatic washer includes a center post extending upwardly from the center of the impeller, the center post including at least one auger vane for lifting cloth items, the method further comprising the steps of:

lifting the cloth items disposed along the center post to promote rollover of the cloth items along the inverse toroidal path.

8. A method of washing cloth items in an automatic washer having a wash chamber and an impeller located within the bottom of a wash chamber, the impeller being rotatable about a vertical axis, the method comprising the steps of:

loading cloth items into the wash chamber;

supplying a quantity of wash liquid into the wash chamber sufficient to wet the cloth items; and oscillating the impeller such that the cloth items directly above the impeller are dragged in an oscillatory manner wherein the cloth items rollover within the wash chamber along an inverse toroidal path.

9. The method of washing cloth items in an automatic washer according to claim 8, further wherein the amount of wash liquid supplied into the wash basket is insufficient to cause the impeller to lose frictional engagement with the cloth items disposed directly above the impeller.

10. The method of washing cloth items in an automatic washer according to claim 8, further wherein the amount of wash liquid supplied into the wash chamber is less than the quantity of wash liquid at which the cloth items lose frictional engagement with the cloth items directly above the impeller wherein the cloth items can not be readily dragged by the impeller.

11. The method of washing cloth items in an automatic washer according to claim 8, further comprising the steps of:

impeding the angular movement of the cloth items disposed along the periphery of the impeller such that relative angular motion is created between the cloth items disposed along the periphery of the impeller and the cloth items disposed immediately above the impeller.

12. The method of washing cloth items according to claim 8, further wherein the automatic washer includes a center post extending upwardly from the center of the impeller, the center post including at least one auger vane for lifting cloth items, the method further comprising the steps of:

lifting the cloth items disposed along the center post to promote rollover of the cloth items along the inverse toroidal path.

13. The method of washing cloth items according to claim 8, further comprising the steps of:

balancing the forces applied to the cloth items above the impeller and the forces applied to cloth items disposed along the periphery of the impeller such that relative angular motion is created between the cloth items above the impeller and the cloth items disposed along the periphery of the impeller wherein cloth items are driven to move along an inverse toroidal path in the wash basket.

14. A method of washing cloth items in an automatic washer having a wash chamber and an impeller located within the bottom of a wash chamber, the impeller being rotatable about a vertical axis, the method comprising the steps of:

loading cloth items into the wash chamber;

supplying a quantity of wash liquid into the wash chamber sufficient to wet the cloth items;

oscillating the impeller to apply a drag force to the cloth items in contact with the impeller such that the cloth items in contact with the impeller move angularly along an arc-like path; and impeding the angular movement of the cloth items disposed along the bottom of the wash chamber beyond the outer periphery of the impeller such that relative angular motion is created between the cloth items disposed along the periphery of the impeller and the cloth items disposed immediately above the impeller, wherein the quantity of wash liquid supplied is insufficient to cause the cloth items to lose frictional engagement with the impeller to such a degree that the impeller can not apply drag forces to the cloth items as the impeller oscillates to move the cloth items along an angular arc-like path, wherein cloth items rollover within the wash basket along an inverse toroidal path.

15. The method of washing cloth items according to claim 14, further wherein the automatic washer includes a center post extending upwardly from the center of the impeller, the center post including at least one auger vane for lifting cloth items, the method further comprising the steps of:

lifting the cloth items disposed along the center post to promote rollover of the cloth items along the inverse toroidal path.

16. The method of washing cloth items according to claim 14, further comprising the steps of:

balancing the forces applied to the cloth items above the impeller and the forces applied to cloth items disposed along the periphery of the impeller such that relative angular motion is created between the cloth items above the impeller and the cloth items disposed along the periphery of the impeller wherein cloth items are driven to move along an inverse toroidal path in the wash basket.

17. A method of washing cloth items in an automatic washer having a wash chamber and an impeller located within the bottom of a wash chamber, the impeller being rotatable about a substantially vertical axis, the method comprising the steps of:

providing a drop zone within the wash chamber beyond the outer periphery of the impeller;

providing a lower transfer zone in the bottom of the wash chamber above the impeller;

providing a feed zone extending upwardly from the center of the impeller;

providing an upper transfer zone along the upper portion of the wash chamber;

loading cloth items into the wash chamber; and oscillating the impeller such that the cloth items in the lower transfer zone are dragged in an oscillatory manner along with the impeller wherein cloth items in the bottom of the drop zone are pulled radially inward resulting in cloth items in the drop zone dropping down to fill the space vacated by cloth items being pulled radially inward while cloth items in the feed zone are pushed upwardly and cloth items in the upper transfer zone move radially outward wherein the movement of cloth items in the drop zone, lower transfer zone, feed zone and upper transfer zone can be defined as an inverse toroidal path.

18. The method of washing cloth items according to claim 17, further wherein the cloth items in the lower transfer zone are dragged by the impeller along an arc-like path while the cloth items in the drop zone are held against oscillatory motion along an arc-like path such that the clothes in the lower transfer zone move relative to the clothes in drop zone.

19. The method of washing cloth items according to claim 18, further comprising the steps of:

supplying a quantity of wash liquid into the wash chamber sufficient to wet the cloth items but insufficient to cause the impeller to lose frictional engagement with the cloth items to such a degree that the impeller can not apply drag forces to the cloth items as the impeller oscillates to move the cloth items along an angular arc-like path.

20. The method of washing cloth items according to claim 17, further wherein the automatic washer includes a center post extending upwardly from the center of the impeller, the center post including at least one auger vane for lifting cloth items, the method further comprising the steps of:

lifting the cloth items disposed along the center post to promote rollover of the cloth items along the inverse toroidal path.

21. The method of washing cloth items according to claim 17, further comprising the steps of:

balancing the forces applied to the cloth items within the drop zone and the lower transfer zone such that relative angular motion is created between the cloth items in the drop zone and the cloth items in the lower transfer zone such that cloth items in the wash basket move along an inverse toroidal path.

22. An automatic washer, comprising:

a cabinet;

a wash tub supported within the cabinet;

a motor suspended beneath the wash tub;

a wash basket rotatably supported within the wash tub and being drivingly connected to the motor;

an impeller disposed in the bottom of the wash basket and drivingly connected to the motor; and a center post extending upwardly from the impeller within the wash basket, the center post having an auger portion including at least one vane, the auger portion being driving connected to the motor for unidirectional motion for lifting clothes.

23. The automatic washer according to claim 22, further wherein the impeller is oscillated and the auger is unidirectionally rotated to move cloth items along an inverse toroidal rollover path in the wash basket.

24. The automatic washer according to claim 22, further comprising:

means for supplying a quantity of wash liquid into the wash chamber sufficient to wet the cloth items but insufficient to cause the cloth items to lose frictional engagement with the impeller as the impeller oscillates.

25. An automatic washer, comprising:

a cabinet;

a wash tub supported within the cabinet;

a motor mounted within the cabinet;

a wash basket rotatably supported within the wash tub and drivingly connected to the motor;

an impeller disposed within the bottom of the wash basket and drivingly connected to the motor, wherein the impeller is oscillated such that the cloth items directly above the impeller are dragged in an oscillatory manner and the cloth items rollover within the wash chamber along an inverse toroidal rollover path.

26. The automatic washer according to claim 25, further comprising:

a center post extending upwardly from the impeller within the wash basket, the center post having an auger portion including at least one vane, the auger portion being driving connected to the motor for unidirectional motion for lifting clothes.

27. The automatic washer according to claim 25, further comprising:

means for supplying a quantity of wash liquid into the wash chamber sufficient to wet the cloth items but insufficient to cause the cloth items to lose frictional engagement with the impeller as the impeller oscillates.

28. An automatic washer having a wash chamber for receiving cloth items to be washed, the washer having an impeller located within the bottom of a wash chamber, the impeller being rotatable about a vertical axis, the automatic washer comprising:

means for supplying a quantity of wash liquid into the wash chamber sufficient to wet the cloth items;

means for oscillating the impeller such that the cloth items directly above the impeller are dragged in an oscillatory manner; and means for impeding the angular movement of the cloth items disposed along the periphery of the impeller such that relative angular motion is created between the cloth items disposed along the periphery of the impeller and the cloth items disposed immediately above the impeller wherein the cloth items rollover within the wash chamber along an inverse toroidal path.

29. The automatic washer according to claim 28, further comprising:

means for supplying a quantity of wash liquid into the wash chamber sufficient to wet the cloth items but insufficient to cause the cloth items to lose frictional engagement with the impeller as the impeller oscillates.

30. The automatic washer according to claim 28, further comprising:

means for lifting the cloth items disposed along the center post to promote rollover of the cloth items along the inverse toroidal path.

31. The automatic washer according to claim 28, further comprising:

means for balancing the forces applied to the cloth items above the impeller and the forces applied to cloth items disposed along the periphery of the impeller such that relative angular motion is created between the cloth items above the impeller and the cloth items disposed along the periphery of the impeller wherein cloth items are driven to move along an inverse toroidal path in the wash basket.

* * * * *